United States Patent [19]

Simeola

[11] 4,081,867

[45] Apr. 4, 1978

[54] PORTABLE SHAMPOO UNIT

[76] Inventor: Mario J. Simeola, P.O. Box 617, Riverhead, N.Y. 11901

[21] Appl. No.: 766,076

[22] Filed: Feb. 7, 1977

[51] Int. Cl.[2] ..... A61H 35/00; A47K 3/12

[52] U.S. Cl. ..... 4/159; 5/327 B

[58] Field of Search ..... 4/159; 5/327 B

[56] References Cited

U.S. PATENT DOCUMENTS

| | | | |
|---|---|---|---|
| 2,163,755 | 6/1939 | Labruzzo | 4/159 |
| 2,818,585 | 1/1958 | Campbell | 4/159 X |
| 2,954,077 | 9/1960 | Wanner | 4/159 |
| 3,164,429 | 1/1965 | Kohl | 4/159 X |
| 3,449,771 | 6/1969 | Watson | 4/159 |
| 3,694,826 | 10/1972 | Pugh | 4/159 |

*Primary Examiner*—Charles E. Phillips
*Attorney, Agent, or Firm*—Robert D. Farkas

[57] ABSTRACT

A portable shampoo unit utilizes a back rest, whose face is covered with a water impervious resilient material hingeably secured to a frame. Both frame and back rest being adapted for resting on a supporting surface such as a bed. A shampoo tray is hingeably affixed to the frame such that the front edge of the tray, in one extreme position, overhangs the back rest and is maintained in substantially a horizontal position and in the other extreme position, is caused to have the rearmost portion of the tray directed downwardly and outwardly of the frame into the open mouth portion of a chamber carried by the frame. The chamber drains into a tank carried by a portable cart utilizing a flexible hose therefor. The cart also carries a fresh water tank which flexibly communicates to a spray nozzle for application of water to the head of a user disposed resting on the padded front edge of the tray, when the tray is in a horizontal position. Upon the user disengaging contact with the tray, the tray automatically tilts rearwardly disgorging the water stored therewithin into the chamber.

5 Claims, 3 Drawing Figures

PORTABLE SHAMPOO UNIT

BACKGROUND OF THE INVENTION

1. Field of the Invention

This invention relates to portable hair washing and shampoo units and more particularly to that class adapted to be partially rested upon beds and the like.

2. Description of the Prior Art

The prior art abounds with portable shampoo devices. U.S. Pat. No. 2,850,742 issued Sept. 9, 1958 to G. E. Glinty and U.S. Pat. No. 3,192,537 issued July 6, 1965 to N. V. Coffman et al both disclose a portable cart having water supply means to which a water receiving tray is coupled. The tray is permitted to reside on the surface of a bed and is adapted to trap water utilized in washing the hair of a person reclining upon the surface of the bed.

U.S. Pat. No. 3,579,656 issued May 25, 1971 to J. S. Guarrasi teaches a cabinet-like apparatus adapted to rest upon the surface of a bed having a water supply compartment communicating to a spray nozzle and a hand pump for pressurizing the contents of the water supply compartment. A collar-like apparatus encircles the neck of the user and is utilized in an inclined position so as to drain water captured thereby directly into another compartment within the cabinet.

The Glinty and Coffman patents both require an operation of tilting a partially water filled tray so as to secure proper drainage prior to the removal thereof from the surface of the bed. The Guarrasi apparatus requires the entire cabinet, ladden with used and unused water, to be lifted onto and from the bed before and after each use.

SUMMARY OF THE INVENTION

A primary object of the present invention is to provide a portable lightweight hair washing apparatus for use with a bed.

Another object is to provide a waste water capturing tray which automatically disgorges waste water into a receiving chamber when the use of the tray is completed.

Still another object is to provide a water resevoir and waste water storage tank which is portable in nature adapted to provision and receive water utilized in washing the hair of a disabled person.

Yet another object is to provide a portable shampoo unit in accordance with the preceeding objects which is simple in construction, relatively inexpensive and effective for its particular purposes.

Heretofore, hair washing units for use with bed confined disabled persons utilized a hair washing tray or pan which was manually placed under the head of the user and which was drained either automatically into a receiving tank disposed adjacent the bed or was manually emptied of its contents after the hair washing operation was completed. Much difficulty is encountered in maintaining the patient in a near sitting position whilst handling a water ladden tray, removing same from the surface of the bed. The present invention automatically disposes the used water into a low slung receiving chamber which in turn can be substantially entirely emptied after the washing process but before removing the patients back from the back rest portion of the present invention.

These objects, as well as other objects of the present invention, will become more readily apparent after reading the following description of the accompany drawings.

DESCRIPTION OF THE PREFERRED EMBODIMENT

The structure and method of fabrication of the present invention is applicable to a planer back rest having a padded water impervious resilient material affixed to a lateral surface thereof. The back rest is hingably secured to a generally rectangular frame such that the back rest, when in a use position, is located in an inclined position relative to the substantially upright position of the frame. The frame is adapted with an opening in the uppermost lateral surface thereof. A bar, passing downwardly through the opening, carries a shampoo tray secured to the upper end thereof. The bar is pivotably secured to the frame such that the upper end of the bar subscribes an arc which at one extreme is closest to the back rest portion of the apparatus and, in the other extreme, is closest to the opposed face of the frame. The front portion of the tray, when pivoted towards the back rest, extends over the back rest so as to provide a contoured padded neck receiving portion whilst the tray is in a substantially horizontal position. A helical spray, having one end thereof secured to a portion of the frame adjacent the back rest and the other end of the spring secured to the lower regions of the bar below the pivot axis thereof, causes the tray, when disengaged from the nape of the neck of the user, to be pivoted away from the back rest such that the rear portion of the tray tips downwardly and outwardly from the uppermost surface of the frame. A water receiving chamber affixed to the frame is provided with an open mouth portion through which the rear portion of the tray is free to enter when the tray is urged in an inclined position. Water in the tray enters the compartment and is fluidly communicated, by way of a drain port and flexible hose, into a vented water receiving tank carried by a wheeled cart. A fresh water supply tank, also carried by the cart, provides fresh water, by way of a flexible hose, to a hand held spray nozzle for application of water to the head of the patient. An electric motor and pump assembly provides pressurized fresh water to the flexible hose coupled to the spray nozzle. Electric switch means control the operation of the electric motor. A filling port is provided on the fresh water supply tank. A drainage valve is provided on the waste water accumulating tank.

Figure 1:
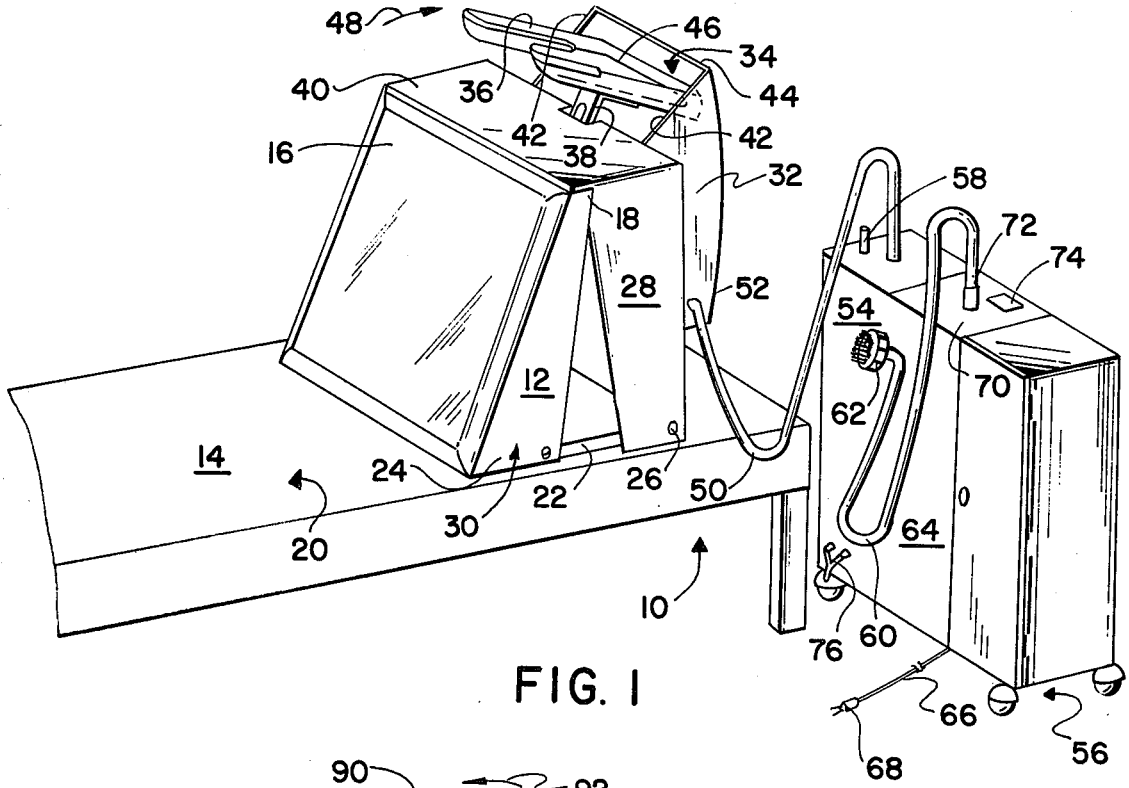
FIG. 1 is a perspective view of the present invention.

Now referring to the Figures, and more particularly to the embodiment illustrated in FIG. 1 showing the present invention 10 shown having a back rest portion 12 resting on bed 14. A rubber-like resilient water impervious pad 16 is attached to back rest 12. Pivot rod 18 facilitates disposing back rest 12 at an angular relationship with uppermost surface 20 of bed 14. Strut 22 utilizes pivot rod 24 to pivotably secure one end of strut 22 to back rest 12, whilst rod 26 directed inwardly of frame 28 secures the other end of strut 22, so as to maintain back rest 12 in the inclined postition shown. When strut 22 is freed from rod 26 and pivoted upwardly in the direction of arrow 30, back rest 12 may be pivoted about pivot rod 18 so as to fold against frame 28, when back rest 12 and frame 28 are not in a use position. Waste water receiving chamber 32 is secured to frame 28 and is provided with an open mouth portion 34. Tray 36 is carried by bar 38 extending over an upper surface 40 of frame 28. Open mouth portion 34 is defined by marginal edges 42 and 44 of chamber 32, residing in a plane extending upwardly and outwardly from surface 40 adapted to receive the rear portion 46 of tray 36 when tray 36 is disposed in the direction of arrow 48. Flexible tubing 50 hydraulically communicates to the interior of the lower regions 52, of chamber 32, into tank 54 carried by rolling cart 56. Vent pipe 58 vents the confines of tank 54 to the atmosphere. Flexible tubing 60 is provided with spray nozzle 62 at one end thereof and communicates into tank 64, carried by cart 56. Electric cord 66 and electric plug 68 provide electrical energy to an electrically operated pump, not shown, when switch 70 completes an electrical circuit into an operative position such that clean water, not shown, within tank 64 is pressurized and coupled to end 72 of flexible tubing 60. Plate 74, when removed covering an opening in tank 64, permits tank 64 to be filled with fresh water. Drainage valve 76 communicates to the interior of tank 54 and is utilized to drain the contents of the tank from the waste water accumulated therein.

Figure 2:
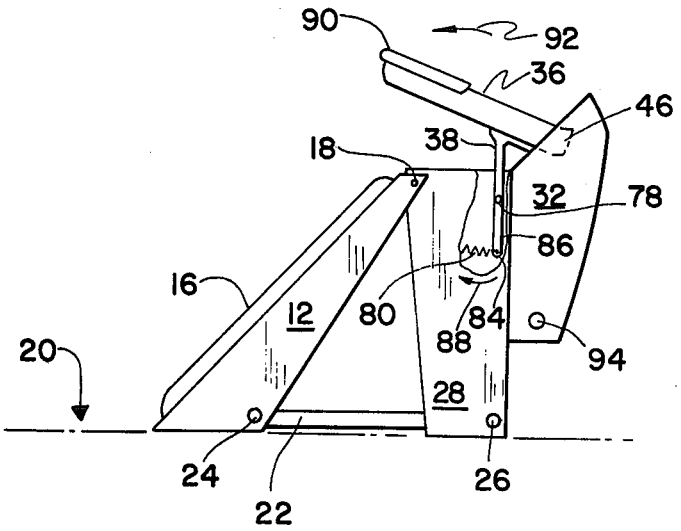
FIG. 2 is a side elevation view of a portion of the present invention.

FIG. 2 illustrates tray 36 in an inclined position having the rear portion 46 thereof disposed within chamber 32. Bar 38 utilizes pivot rod 78 to pivotably secure the bar to frame 28. Helical spring 80 has an end thereof secured to frame 28 and end 84 thereof secured to bar 38. Spring 80 causes end 86 of bar 38 to move in the direction of arrow 88. When the nape of the neck of the user, not shown, is placed on the front end 90 of tray 36, the bias forces exerted by spring 80 are overcome, causing tray 36 to pivot in the direction of arrow 92 and to reside in a substantially horizontal plane having front portion 90 extend over pad 16. Opening 94 is adapted to receive flexible tubing 50, shown in FIG. 1.

Figure 3:
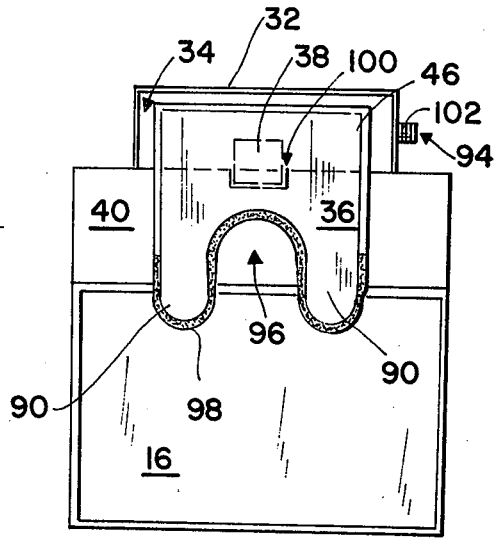
FIG. 3 is a plan view of a portion of the present invention.

FIG. 3 shows tray 36 having front portions 90 residing over pad 16. Notch 96 is formed in the front portions of tray 36 to accommodate the nape of the neck of the user, not shown. Resilient padding 98 covers the marginal edge of tray 36 adjacent portions 90 to protect the head and neck of the user. Notch 100 accommodates bar 38. Opening 94 is formed within hose coupler 102 attached to a side wall of chamber 32.

One of the advantages is to provide a portable lightweight hair washing apparatus for use with a bed.

Another advantage is to provide a waste water capturing tray which automatically disgorges waste water into a receiving chamber when the use of the tray is completed.

Still another advantage is to provide a water resevoir and waste water storage tank which is portable in nature adapted to provision and receive water utilized in washing the hair of a disabled person.

Yet another advantage is to provide a portable shampoo unit in accordance with the preceeding objects which is simple in construction, relatively inexpensive and effective for its particular purposes.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A portable shampoo unit for use on a horizontal surface comprising a back rest, a frame, the frame hingably secured to the back rest, the frame supporting the back rest in an inclined position with respect to the horizontal surface when the frame and the back rest are set up for use, a chamber, the chamber secured to the and frame having an open mouth portion extending upwardly and outwardly from the the frame being normal to said horizontal surface frame, a shampoo tray having a front and a rear region, means to pivotably secure the shampoo tray to the frame, the pivotable securing means including positioning the front region of the tray extending toward the back rest, the pivotable securing means including positioning the rear region of the tray into the open mouth portion of the chamber, means to bias the rear region of the tray towards the open mouth portion of the chamber.

2. The portable shampoo unit as claimed in claim 1 further comprising a portable cart, the cart carrying a pair of tanks, one of the pair of tanks hydraulically communicating to a spray nozzle, the chamber having a drainage port, the drainage port hydraulically communicating to the other of the pair of tanks.

3. The portable shampoo unit as claimed in claim 1 wherein the back rest is padded with a water impervious resilient material on its face against which the back of a user rests.

4. The portable shampoo unit as claimed in claim 1 wherein the front region of the tray is padded with a water impervious resilient material.

5. The portable shampoo unit as claimed in claim 1 wherein the bias means comprises a helical spring, one end of the spring fixedly secured to the frame, a bar, one end of the bar fixedly secured to a lower lateral surface of the tray, the bar pivotably secured to the frame, the other end of the spring fixedly secured to a point on the bar adjacent the other end thereof.

* * * * *